US006924784B1

(12) United States Patent
Yeo et al.

(10) Patent No.: US 6,924,784 B1
(45) Date of Patent: Aug. 2, 2005

(54) METHOD AND SYSTEM OF DRIVING DATA LINES AND LIQUID CRYSTAL DISPLAY DEVICE USING THE SAME

(75) Inventors: Ju Cheon Yeo, Anyang-shi (KR); Yong Min Ha, Anyang-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/573,573

(22) Filed: May 19, 2000

(30) Foreign Application Priority Data

May 21, 1999 (KR) ..... 1999-18570

(51) Int. Cl.[7] ..... G09G 3/36
(52) U.S. Cl. ..... 345/98; 345/100
(58) Field of Search ..... 345/87, 98, 100, 345/204, 92, 94, 99, 211–213

(56) References Cited

U.S. PATENT DOCUMENTS

| | | | | | |
|---|---|---|---|---|---|
| 3,641,511 | A | * | 2/1972 | Cricchi et al. | 365/156 |
| 5,510,807 | A | | 4/1996 | Lee et al. | 345/103 |
| 5,892,493 | A | * | 4/1999 | Enami et al. | 345/94 |
| 6,064,363 | A | * | 5/2000 | Kwon | 345/98 |
| 6,282,136 | B1 | * | 8/2001 | Sakurai et al. | 365/203 |
| 6,307,681 | B1 | * | 10/2001 | Aoki et al. | 359/645 |
| 6,563,743 | B2 | * | 5/2003 | Hanzawa et al. | 365/189.02 |
| 2001/0052887 | A1 | * | 12/2001 | Tsutsui et al. | 345/87 |

FOREIGN PATENT DOCUMENTS

| | | |
|---|---|---|
| DE | 198 25 276 A1 | 6/1998 |
| EP | 0 678 210 B1 | 10/1995 |
| EP | 0678848 | 10/1995 |
| EP | 0 678 849 A1 | 10/1995 |
| EP | 0 755 044 A1 | 1/1997 |
| EP | 797182 | 9/1997 |
| EP | 0 899 712 A2 | 3/1999 |
| EP | 0899712 | 3/1999 |
| EP | 0926654 | 6/1999 |
| JP | 10097223 | 4/1998 |
| JP | 10-097224 | 4/1998 |
| JP | 10104569 | 4/1998 |
| JP | 10-105126 | 4/1998 |
| JP | 11-038946 | 2/1999 |
| JP | 11160730 A1 | 6/1999 |
| WO | 94/16428 | 7/1994 |

OTHER PUBLICATIONS

"*A 1.35–in.–diagonal Wide–Aspect–Ratio poly–Si TFT LCD with 513k Pixels*," by Toshikazu Mackawa, Yoshiko Nakayama, Yoshiharu Nakajima, Masumitsu Ino, Haruhiko Kaneko, Masahiko Satoh and Mikiya Kobayashi, Sony Corporation, Kanagawa, Japan, pp:414–7.

* cited by examiner

*Primary Examiner*—Amare Mengistu
(74) *Attorney, Agent, or Firm*—McKenna Long & Aldridge LLP

(57) ABSTRACT

A data line driving method for a liquid crystal display device that does not require a separate pre-charge circuit and is capable of reducing pre-charge time operates by charging data lines to a desired level in response to a control signal for sampling the data lines. In one aspect, such a data line driving method includes the steps of generating a control signal; mutually short-circuiting the data lines in response to the control signal; pre-charging data lines to a desired level; mutually open-circuiting the data lines in response to the control signal; and sequentially applying video signals to the data lines in response to the control signal. A liquid crystal display device operable according to such a method includes data driving means for generating a pre-charging signal having a desired level; means for generating a control signal; and switching means for commonly applying the pre-charging signal to the data lines in response to the control signal, to pre-charge the data lines.

15 Claims, 11 Drawing Sheets

METHOD AND SYSTEM OF DRIVING DATA LINES AND LIQUID CRYSTAL DISPLAY DEVICE USING THE SAME

This application claims the benefit of Korean Patent Application No. 1999-18570, filed on May 21, 1999, which is hereby incorporated by reference for all purposes as if fully set forth herein.

BACKGROUND OF THE INVENTION

1. Field of the Invention

This invention relates to a method of driving data lines in a liquid crystal display (LCD), and more particularly to a data line driving method wherein the data lines are pre-charged using sampling switch control signals of the data lines to thereby be initialized and a liquid crystal display device employing the method.

2. Description of the Related Art

A liquid crystal display (LCD) is a flat panel display device having the benefits of a small size, a thin thickness and low power consumption. Such an LCD has been used for a notebook personal computer (PC), office automation equipment and audio/video equipment, etc. Particularly, an LCD of the active matrix type makes use of a thin film transistor (TFT) as a switching device to display a dynamic image. Recently, there has been actively made a study as to a poly-silicon TFT capable of integrating more peripheral driving circuits than the existent amorphous silicon TFT.

As shown in FIG. 1, such an LCD includes a pixel array 10 having pixels (or picture elements) arranged at intersections between Nn data lines DL11, DL12, . . . , DLNn and m gate lines GL1, GL2, . . . , GLm in a matrix pattern, and a sampling switch part 20 installed between N video bus lines VL1, VL2, . . . , VLN and the Nn data lines DL11, DL12, . . . , DLNn to apply video signals Video1, Video2, . . . , VideoN to the data lines DL11, DL12, . . . , DLNn. The sampling switch part 20 applies the N video signals Video1, Video2, . . . , VideoN to the Nn data lines DL11, DL12, . . . , DLNn to reduce the number of video bus lines VL1, VL2, . . . , VLN. This sampling switch part 20 includes N demultiplexors DMX1, . . . , DMXN connected between any one line of the N video bus lines VL1, VL2, . . . , VLN and n data lines. Each of the demultiplexors DMX1, . . . , DMXN includes n TFTs.

Each of TFTs T11, T12, . . . , TNn is turned on in accordance with control signals $\phi$1, $\phi$2, . . . , $\phi$n to apply video signals coupled via demultiplexor input lines DIL1, . . . , DILN connected to any one line of the N video bus lines VL1, VL2, . . . , VLN to the data lines. The control signals $\phi$1, $\phi$2, . . . , $\phi$n applied to gate terminals of the TFTs T11, T12, . . . , TNn are generated by a demultiplexor control signal generator 22. As shown in FIG. 2, each of the control signals $\phi$1, $\phi$2, . . . , $\phi$n is synchronized with the video signal during one horizontal synchronizing signal interval 1H to be changed sequentially into a high logic level. Each TFT T11, T12, . . . , TNn is sequentially turned on in response to the control signals $\phi$1, $\phi$2, . . . , $\phi$n to sequentially apply the corresponding video signal to the data lines DL11, DL12, . . . , DLNn.

Meanwhile, in order to improve picture quality, data voltages having the contrary polarity with respect to each other are applied to the adjacent data lines DL11, DL12, . . . , DLNn. Thus, the pixels are charged or discharged to a different voltage level to generate a voltage difference. The voltage difference in the pixels cause a color signal difference and a brightness difference between the adjacent pixels to deteriorate the picture quality. For instance, as shown in FIG. 3, red pixel connected to the first data line DL11 and the adjacent green pixel are supplied with 6V and −3V respectively whereas blue pixel connected to the third data line DL13 is supplied with 6V. In this case, the pixels are charged to 5.8V, −2.8V, and 5.9V respectively, by their coupling with the adjacent pixels, so that a desired color signal and brightness can not be obtained. Also, if data voltages with opposite polarity are applied to the data lines DL11, DL12, . . . , DLNn, then the power consumption is increased because each line has a voltage difference as large as a voltage variation difference between the data lines or the pixels.

In order to overcome this problem, as shown in FIG. 1, the LCD includes a pre-charging switch part 30 for charging the data lines DL11, DL12, . . . , DLNn to a certain intermediate level. The pre-charging switch part 30 charges all of the data lines DL11, DL12, . . . , DLNn into a pre-charging signal Vpc before application of the video signals to initialize the data lines DL11, DL12, . . . , DLNn. The pre-charging signal Vpc is supplied from a pre-charge line PCL provided at the lower end of the pixel array 10. The pre-charging switch part 30 includes Nn TFTs CT11, CT12, . . . , CTNn connected between the data lines DL11, DL12, . . . , DLNn and the pre-charge line PCL. Each of the TFTs CT11, CT12, . . . , CTNn is turned on in accordance with a pre-charge control signal Pre-EN to connect all of the data lines DL11, DL12, . . . , DLNn to the pre-charge line PCL. As seen from FIG. 2, the pre-charge control signal Pre-EN is generated from the control signal generator 32 before the video signals are applied to the data lines DL11, DL12, . . . , DLNn.

If the data lines DL11, DL12, . . . , DLNn are charged into an intermediate voltage before data is supplied, then the voltage variation is reduced by one-half during the charge or discharge of the data lines or the pixels, so that coupling between the data lines or the pixels is reduced to improve the picture quality characteristic. The power consumption is reduced as much as the voltage variation width is reduced due to the pre-charge. Also, a swing width of an output signal of a data driver (not shown) for applying video signals to video bus lines VL1, VL2, . . . , VLN is reduced by one-half, so that the charge time of the data lines or the pixels is reduced.

On the other hand, as shown in FIG. 4, the pre-charge line PCL may be provided at the upper portion of the pixel array 10. In this case, pre-charging TFTs CT11, CT12, . . . , CTNn are provided between the pre-charge line PCL and the demultiplexor TFTs T11, T12, . . . , TNn.

However, the conventional pre-charging switch part 30 has a drawback in that, since it requires the additional TFTs CT11, CT12, . . . , CTNn and the pre-charge control signal generator 32, the effective display area of the display panel is reduced. Also, it has a drawback in that, since the pre-charge control signal in the prior art requires a level shifter to produce a high voltage pulse of 15 to 20 Vpp, its manufacturing cost rises. Moreover, the conventional pre-charge switch part 30 has a problem in that, since a leakage current is generated by the TFTs CT11, CT12, . . . , CTNn to cause a voltage variation in the data lines or the pixels, the picture quality is deteriorated.

SUMMARY OF THE INVENTION

Accordingly, it is an object of the present invention to provide a data line driving method that does not require a separate pre-charge circuit, and to provide a liquid crystal display device employing the same.

A further object of the present invention is to provide a data line driving method that is capable of reducing pre-charge time, and to provide a liquid crystal display device employing the same.

In order to achieve these and other objects of the invention, a data line driving method according to one aspect of the present invention includes charging data lines to a desired level in response to a control signal for sampling the data lines.

A data line driving method according to another aspect of the present invention includes the steps of charging data lines to a desired level in response to a control signal, and applying video signals to the data lines in response to the control signal.

A data line driving method according to still another aspect of the present invention includes the steps of generating a control signal; mutually short-circuiting the data lines in response to the control signal; pre-charging data lines to a desired level; mutually open-circuiting the data lines in response to the control signal; and sequentially applying video signals to the data lines in response to the control signal.

A liquid crystal display device according to still another aspect of the present invention includes data driving means for generating a pre-charging signal having a desired level; means for generating a control signal; and switching means for commonly applying the pre-charging signal to the data lines in response to the control signal to pre-charge the data lines.

A liquid crystal display device according to still another aspect of the present invention includes means for generating a control signal; a sampling switch device, being responsive to the control signal, to switch between the video input lines and the data lines; and a pre-charge switch device, being responsive to the control signal, to mutually short the data lines.

A liquid crystal display device according to still another aspect of the present invention includes a pre-charging signal source for generating means for generating a pre-charging signal having a desired level; means for generating a control signal; a sampling switch device, being responsive to the control signal, to switch between the video input lines and the data lines, a pre-charging line for commonly applying the pre-charging signal to the data lines; and a pre-charge switch device, being responsive to the control signal, to switch a path between the data line and the pre-charging line.

A liquid crystal display device according to still another aspect of the present invention includes a pre-charging signal source for generating a pre-charging signal having a desired level; means for generating a control signal; a demultiplexor, being responsive to the control signal, to apply a single video signal to a plurality of data lines; a pre-charging line supplied with the pre-charging signal; and a pre-charge switch device, being responsive to the control signal, to switch between an input line of the demultiplexor and the pre-charging line.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
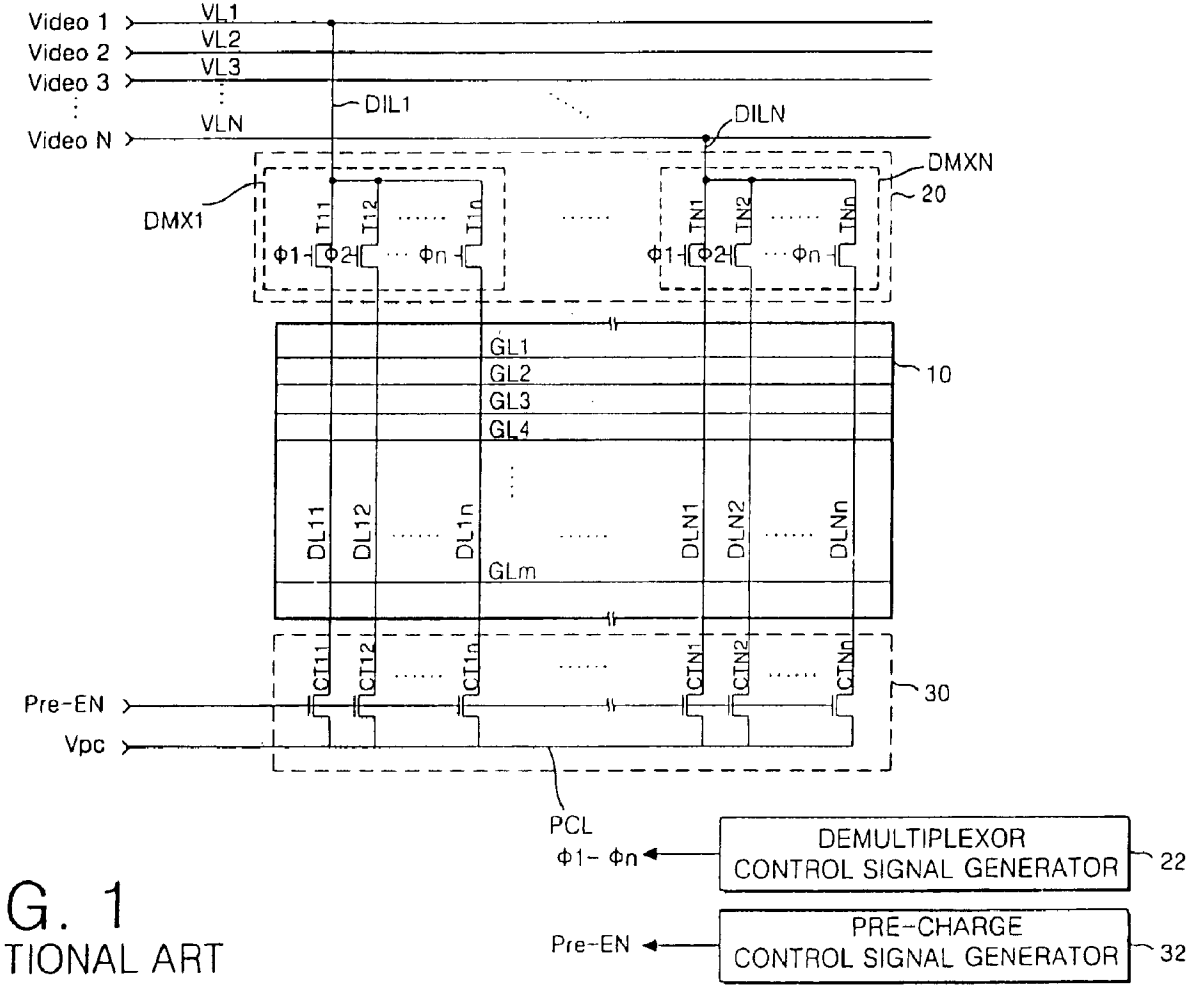
FIG. 1 CONVENTIONAL ART
FIG. 1 is a schematic view showing the configuration of a conventional liquid crystal display device.
Figure 2:
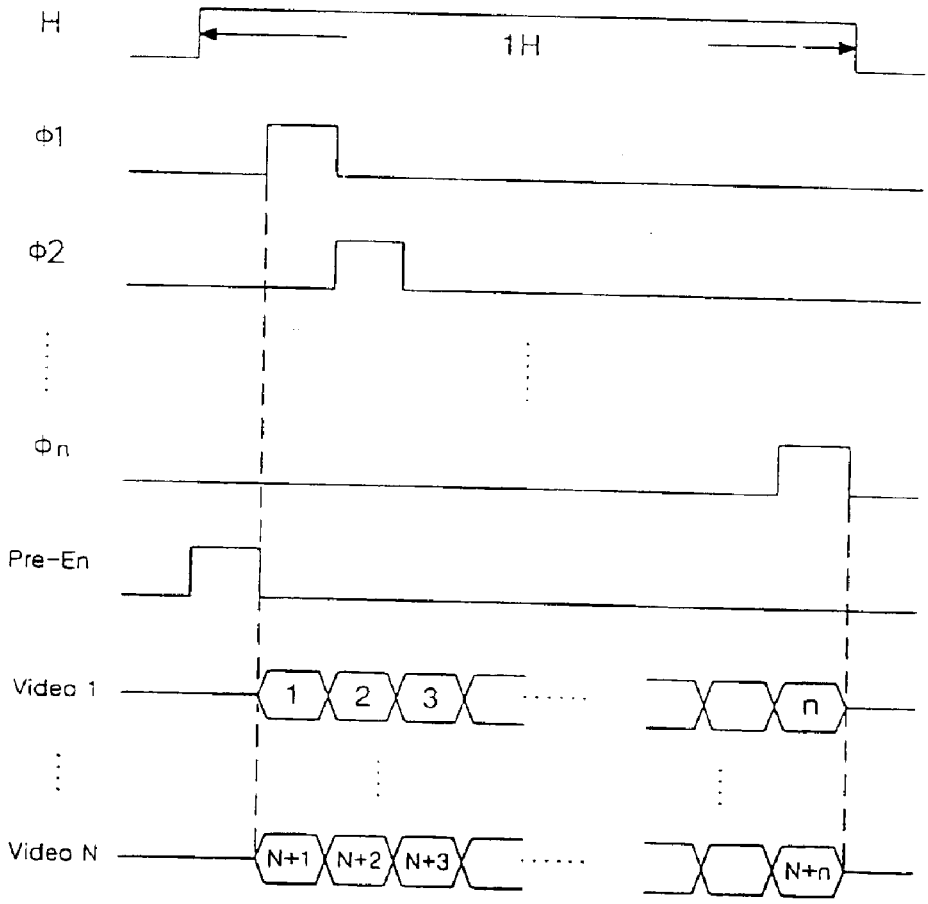
FIG. 2 CONVENTIONAL ART
FIG. 2 is waveform diagrams of data line driving signals in the liquid crystal display device of FIG. 1.
Figure 3:
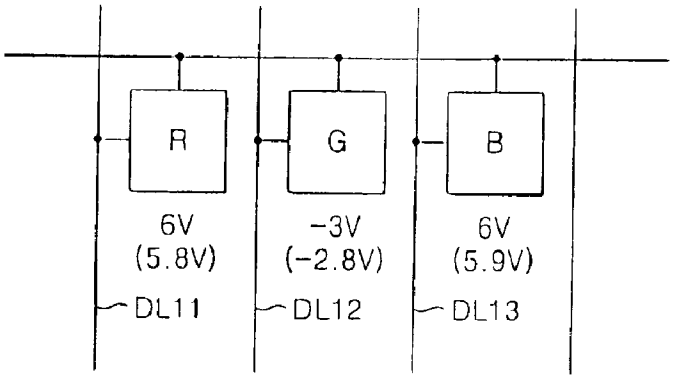
FIG. 3 CONVENTIONAL ART
FIG. 3 illustrates voltage variation in the data lines in FIG. 1.
Figure 4:
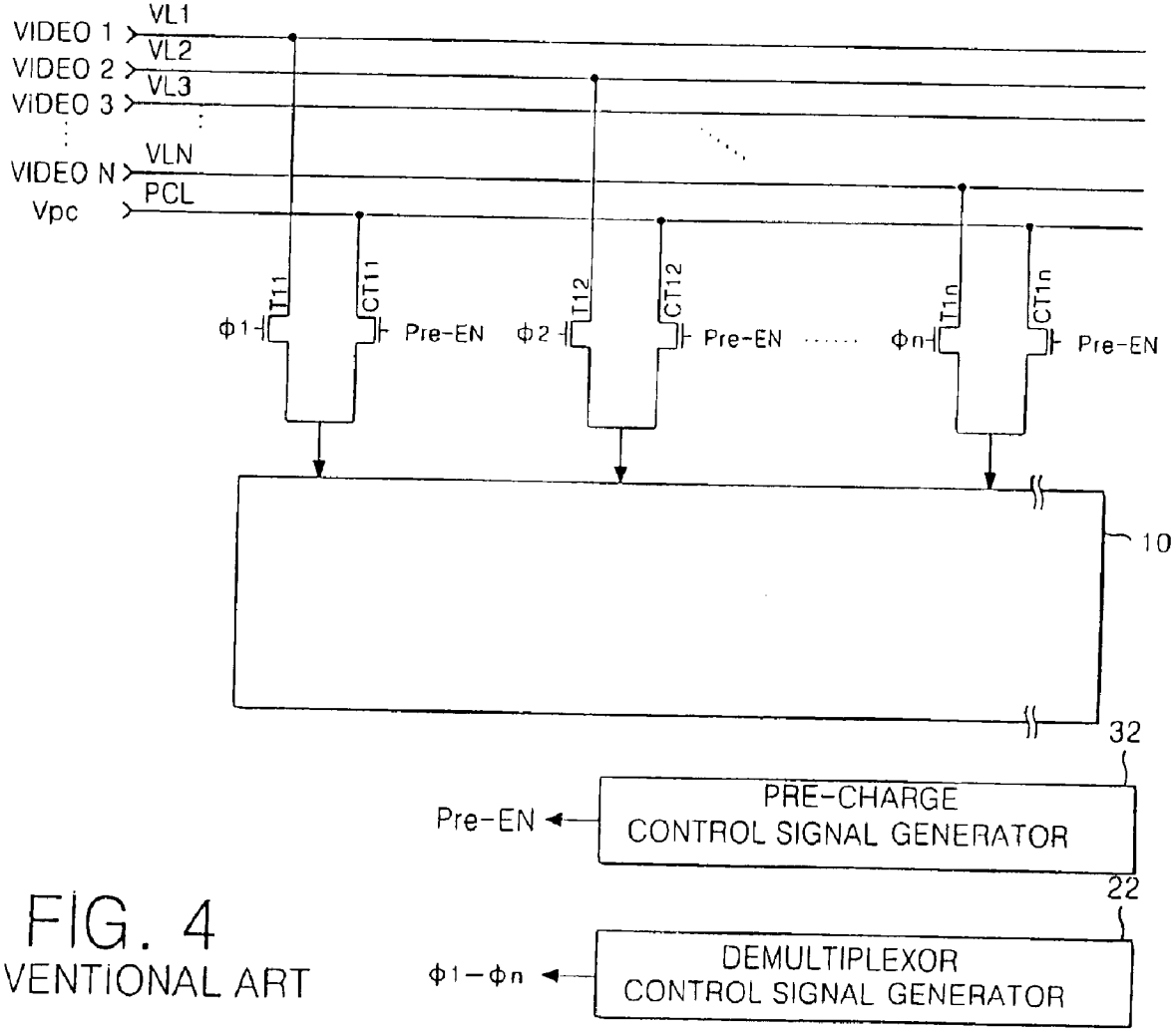
FIG. 4 CONVENTIONAL ART
FIG. 4 is a schematic view showing the configuration of another conventional liquid crystal display device.
Figure 5:
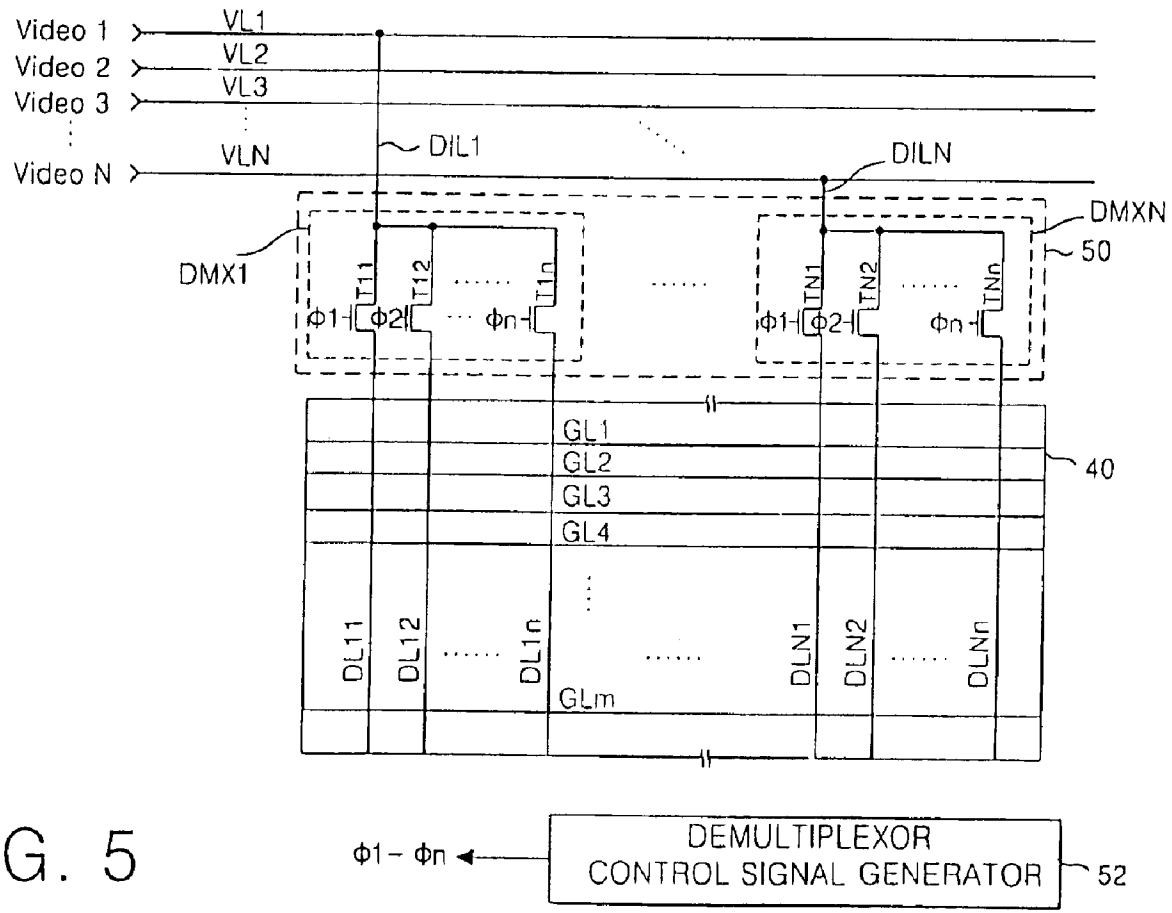
FIG. 5 is a schematic view showing the configuration of a liquid crystal display device according to a first embodiment of the present invention.
Figure 6:
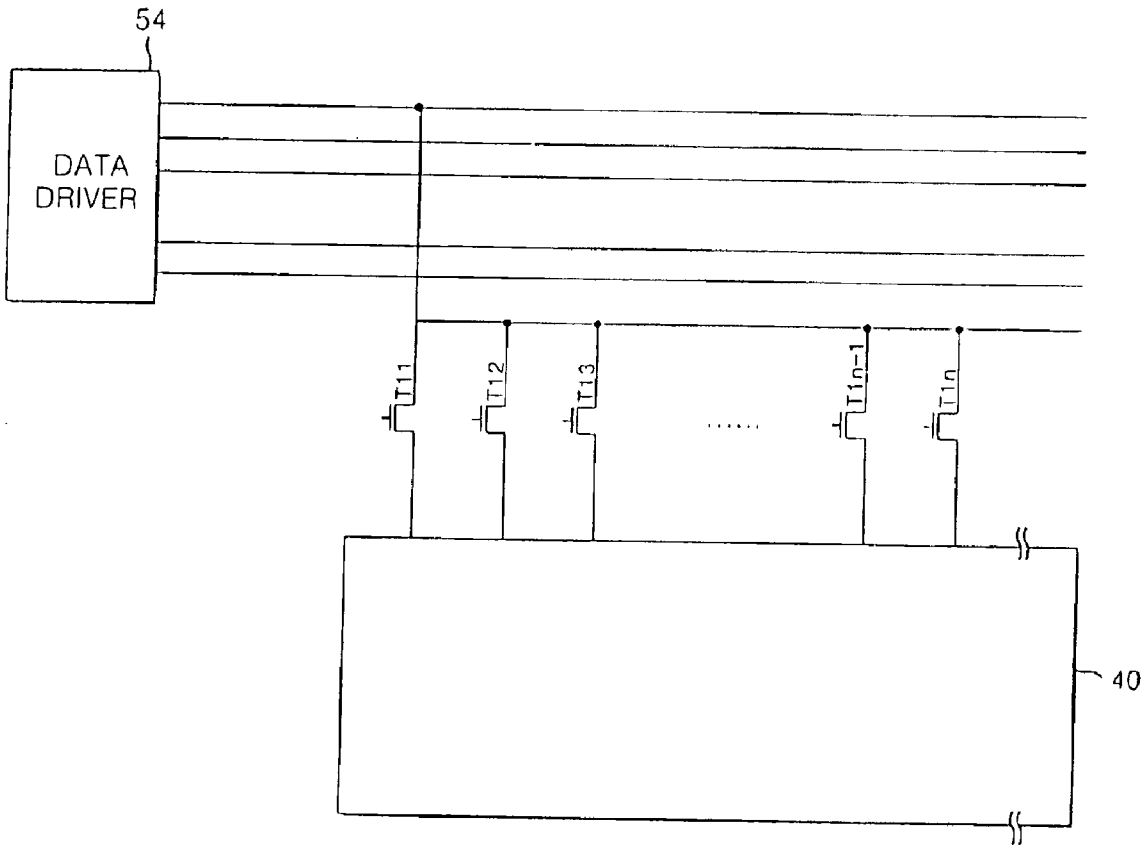
FIG. 6 is a configuration view of a data driver in the liquid crystal display device shown in FIG. 5.

Referring to FIG. 5 and FIG. 6, there is shown a liquid crystal display device according to a first embodiment of the present invention. The liquid crystal display device includes a pixel array 40 having pixels (or picture elements) arranged at intersections between Nn data lines DL11, DL12, . . . , DLNn and m gate lines GL1, GL2, . . . , GLm in a matrix pattern, a pre-charge/sampling switch part 50 installed between N video bus lines VL1, VL2, . . . , VLN and the Nn data lines DL11, DL12, . . . , DLNn to apply a pre-charging signal and video signals Video1, Video2, . . . , VideoN to the data lines DL11, DL12, . . . , DLNn, and a data driver 54 for generating the pre-charge signal and the video signals Video1, Video2, . . . , VideoN. The pre-charge/sampling switch part 50 sequentially applies the pre-charging signal to all of the data lines DL11, DL12, . . . , DLNn, and thereafter applies the video signals Video1, Video2, . . . , VideoN sequentially to the Nn data lines DL11, DL12, . . . , DLNn. This pre-charge/sampling switch part 50 includes N demultiplexors DMX1, . . . , DMXN connected between any one line of the N video bus lines VL1, VL2, . . . , VLN and n data lines. Each of the demultiplexors DMX1, . . . , DMXN includes n TFTs.

Each of TFTs T11, T12, . . . , TNn is turned on in accordance with control signals $\phi$1, $\phi$2, . . . , $\phi$n to apply the pre-charging signal and the video signals Video1, Video2, . . . , VideoN coupled via demultiplexor input lines DIL1, . . . , DILN connected to any one line of the N video bus lines VL1, VL2, . . . , VLN to the data lines DL11, DL12, . . . , DLNn. The control signals $\phi$1, $\phi$2, . . . , $\phi$n applied to gate terminals of the TFTs T11, T12, . . . , TNn are generated from a demultiplexor control signal generator 52. The data driver 54 is commonly connected to the video bus lines VL1, VL2, . . . , VLN to sequentially apply the pre-charging signal and the video signals Video 1, Video2, . . . , VideoN to the video bus lines VL1, VL2, . . . , VLN.

Figure 7:
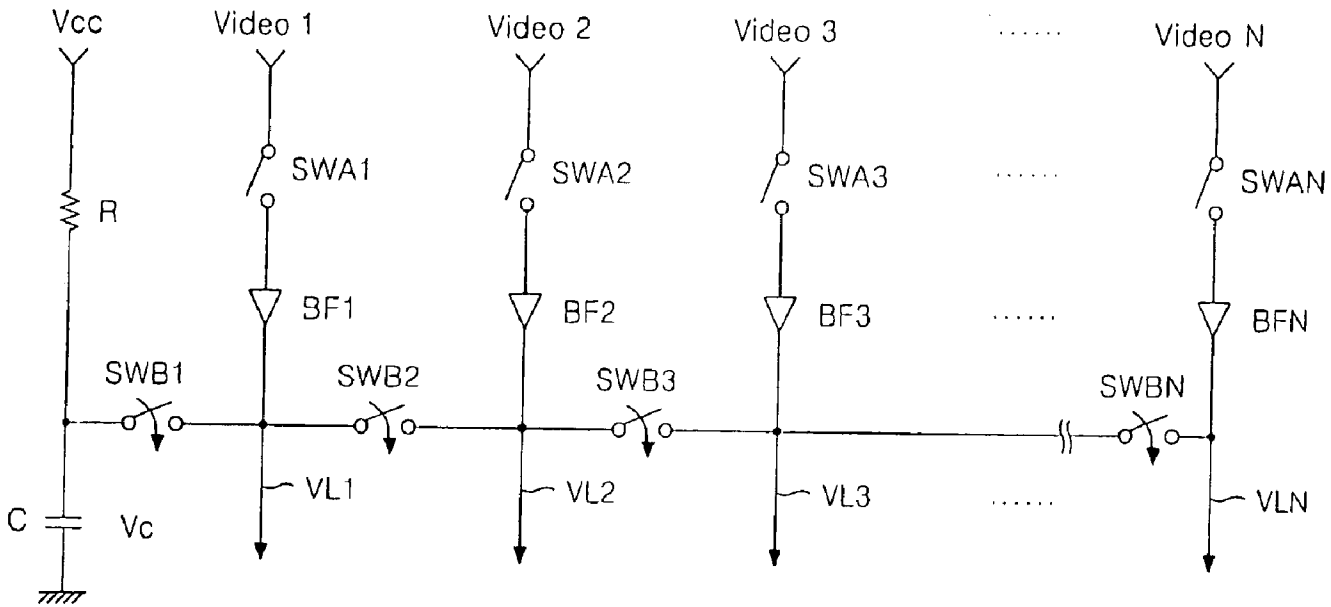
FIG. 7 is a detailed view of the output part of the data driver shown in FIG. 6.

As shown in FIG. 7, the data driver 54 includes buffers BF1, BF2, . . . , BFN connected to the respective video bus lines VL1, VL2, . . . , VLN, video signal switches SWA1, SWA2, . . . , SWAN for switching the video signals Video1, Video2, . . . , VideoN, a capacitor C for charging and discharging a supply voltage Vcc, and pre-charging signal switches SWB1, SWB2, . . . , SWBN for applying a charge voltage Vc of the capacitor C to the video bus lines VL1, VL2, . . . , VLN. The buffers BF1, BF2, . . . , BFN matches a voltage level of the video signals Video1, Video2, . . . , VideoN into a level suitable for the pixel array 40. The video signal switches SWA1, SWA2, . . . , SWAN are closed in a time interval when the capacitor C is being charged, and are opened in a time interval when the capacitor C is being discharged. The pre-charging signal switches SWB1, SWB2, . . . , SWBN are opened in a time interval when the capacitor C is being charged, and are closed in a time interval when the capacitor C is being discharged. The capacitor C generates a pre-charging signal, being charged by supply voltage Vcc in a time interval when the pre-charging signal switches SWB1, SWB2, . . . , SWBN are opened, and discharging the charged voltage in a time interval when the video signals Video1, Video2, . . . , VideoN are applied, that is, when the pre-charging signal switches SWB1, SWB2, . . . , SWBN are closed.

Figure 8:
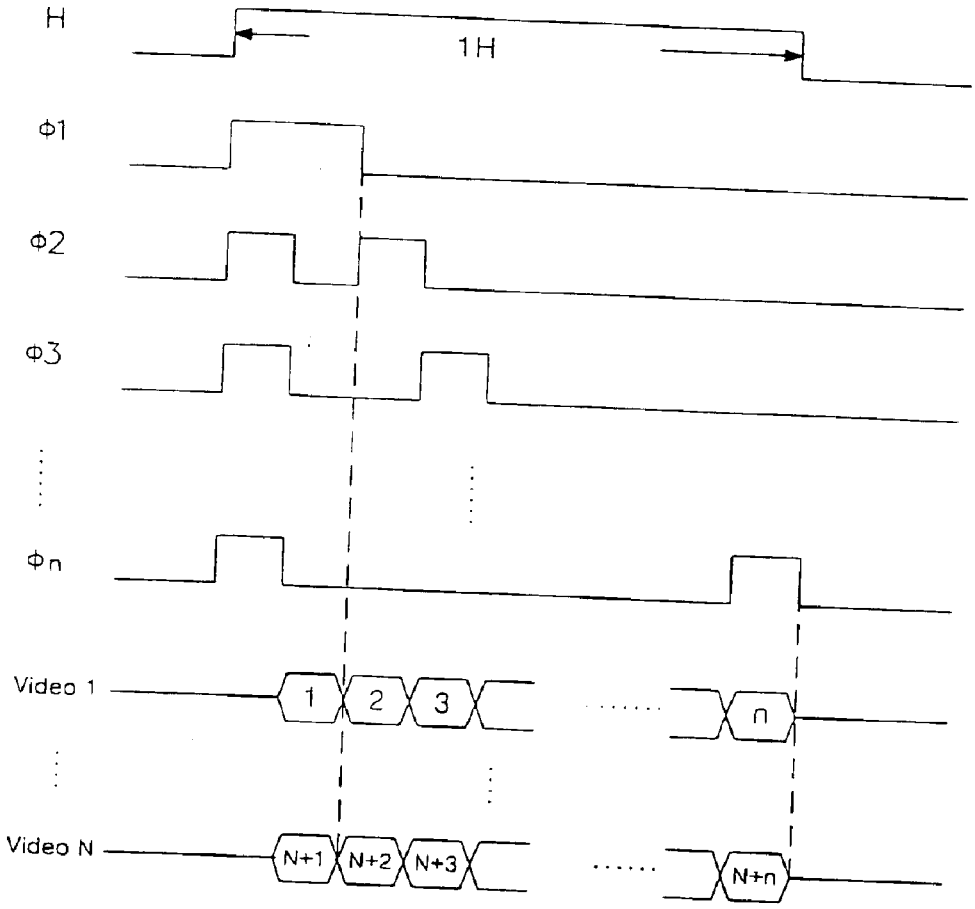
FIG. 8 shows waveform diagrams of data line driving signals in the liquid crystal display device of FIG. 5.

As shown in FIG. 8, each of the control signals $\phi 1$, $\phi 2$, . . . , $\phi n$ is simultaneously changed to a high logic level and then is synchronized with the video signal during one horizontal synchronizing signal interval 1H to be sequentially changed to a high logic level. More specifically, the horizontal synchronizing signal H is changed into a high level and, at the same time, all of the first to nth control signals $\phi 1$, $\phi 2$, . . . , $\phi n$ are changed to a high level. Then, the TFTs T11, T12, . . . , TNn are simultaneously turned on in response to the first to nth control signals $\phi 1$, $\phi 2$, . . . , $\phi n$ to commonly apply the pre-charging signal to the data lines DL11, DL12, . . . , DLNn. At this time, the video signal switches SWA1, SWA2, . . . , SWAN maintain an opened state, whereas the pre-charging signal switches SWB1, SWB2, . . . , SWBN maintain a closed state. After an application of the pre-charging signal, the first control signal $\phi 1$ remains at a high logic level while the second to nth control signals $\phi 2$ to $\phi n$ are inverted to a low logic level. At the same time, the video signal switches SWA1, SWA2, . . . , SWAN are closed, whereas the pre-charging signal switches SWB1, SWB2, . . . , SWBN are opened. Accordingly, the first TFTs T11 . . . TN1 maintains a turned-on state in response to the first control signal $\phi 1$ to apply the video signals Video1, Video2, . . . , VideoN to the data lines DL11, DL21, . . . , DLN1, whereas the TFTs T12, T13, . . . , T1*n*, . . . , TN2, TN3, . . . , TNn are turned off. Subsequently, the first control signal $\phi 1$ is inverted to a low level while the second to nth control signals $\phi 2$ to $\phi n$ are sequentially changed to a high logic. At this time, the video signal switches SWA1, SWA2, . . . , SWAN maintain a closed state, whereas the pre-charging signal switches SWB1, SWB2, . . . , SWBN maintain an opened state. Thus, the second to nth TFTs T12, T13, . . . , T1*n*, . . . , TN2, TN3, . . . , TNn are sequentially turned on to apply the video signals Video 1, Video2, . . . , VideoN to the data lines DL12, DL13, . . . , DL1*n*, . . . , DLN2, DLN3, . . . , DLNn.

As described above, the liquid crystal display device according to the first embodiment of the present invention makes use of the control signals $\phi 1$, $\phi 2$, . . . , $\phi n$ generated from the demultiplexor control signal generator 52 to provide a pre-charge and drive the data lines DL11, DL12, . . . , DLNn. As a result, it does not require a driving circuit for generating separate pre-charge control signals as well as TFTs for switching the pre-charging signal. In addition, it can reduce pre-charge time by utilizing demultiplexor TFTs with good charging ability or good driving ability as the pre-charging TFTs. Meanwhile, a pre-charge signal may be generated by converting the capacitor C into a floating state when all of the output lines or the output pins of the data driver have been short-circuited; otherwise it may be generated by a separate voltage supply instead of the capacitor C.

Figure 9:
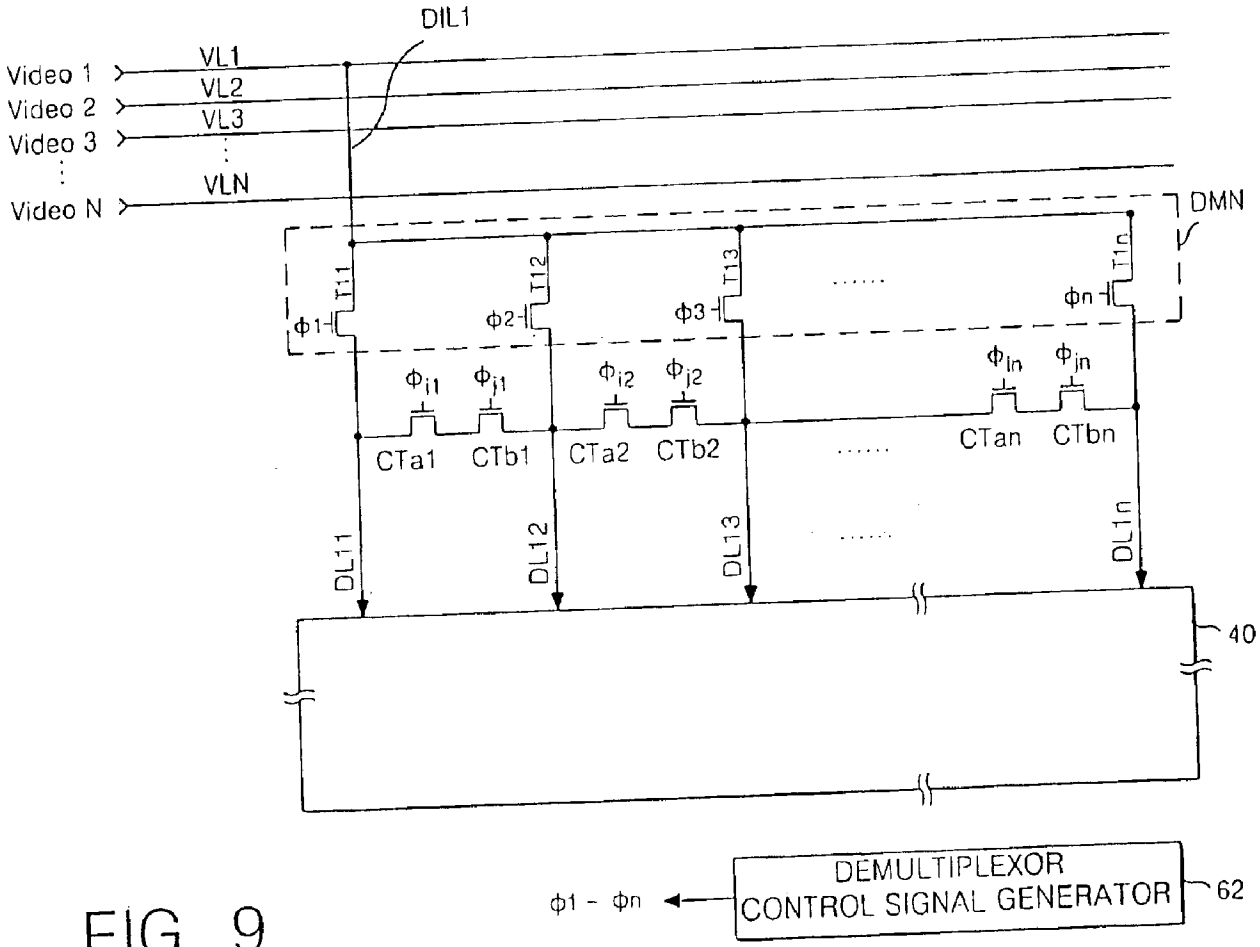
FIG. 9 is a schematic view showing the configuration of a liquid crystal display device according to a second embodiment of the present invention.

Referring now to FIG. 9, there is shown a liquid crystal display device according to a second embodiment of the present invention. The liquid crystal display device includes pre-charging TFTs CTa1, CTb1, . . . , CTbn connected, in series, between the data lines DL11, DL12, . . . , DL1*n* to commonly couple the data lines DL11, DL12, . . . , DL1*n*.

The pre-charging TFTs CTa1, CTb1, . . . , CTbn are arranged such that two pre-charging TFTs are connected, in series, between the adjacent data lines, for example, between the first data line DL11 and the second data line DL12. Also, the pre-charging TFTs CTa1, CTb1, . . . , CTbn are arranged such that two pre-charging TFTs are connected, in series, between the adjacent demultiplexor TFTs, for example, between the first demultiplexor TFT T11 and the second demultiplexor TFT T12. In other words, the first and second pre-charging TFTs CTa1 and CTb1 connected between the first and second data lines DL11 and DL12 are connected, in series, between the first and second demultiplexor TFTs T11 and T12. A control signal applied to the pre-charging TFTs CTa1, CTb1, . . . , CTbn is identical to a control signal of the demultiplexor TFTs connected to the adjacent data lines. Thus, each of the pre-charging TFTs CTa1, CTb1, . . . , CTbn is controlled simultaneously with the demultiplexor TFTs connected to the adjacent data lines in response to the control signals $\phi 1$, $\phi 2$, . . . , $\phi n$ generated from the demultiplexor control signal generator 62. For instance, the second control signal $\phi 2$ controls the second demultiplexor TFT T12, the second pre-charging TFT CTb1 and the third pre-charging TFT CTa2 simultaneously. Accordingly, the second control signal $\phi 2$ becomes control signals $\phi j1$ and $\phi i2$ for controlling the second pre-charging TFT CTb1 and the third pre-charging TFT CTa2.

Each of the control signals $\phi 1$, $\phi 2$, . . . , $\phi n$ is substantially identical to that in FIG. 8. In other words, each of the control signals $\phi 1$, $\phi 2$, . . . , $\phi n$ is simultaneously changed to a high logic level in one horizontal synchronizing signal interval 1H. Thus, the horizontal synchronizing signal H is changed to a high logic level and, at the same time, all of the control signals $\phi 1$, $\phi 2$, . . . , $\phi n$ are changed to a high level to turn on the pre-charging TFTs CTa1, CTb1, . . . , CTbn simultaneously, thereby short-circuiting all of the data lines DL11, DL12, . . . , DL1*n*. The video signal is applied to the data lines DL11, DL12, . . . , DL1*n* when the pre-charging TFTs CTa1, CTb1, . . . , CTbn are turned on, thereby pre-charging all of the data lines DL11, DL12, . . . , DL1*n* into the same level. After the data lines DL11, DL12, . . . , DL1*n* are pre-charged, each of the control signals $\phi 1$, $\phi 2$, . . . , $\phi n$ is synchronized with the video signals Video1, Video2, . . . , VideoN to be sequentially changed to a high logic level. Since two pre-charging TFTs are connected, in series, between the adjacent data lines during an application of the video signals Video1, Video2, . . . , VideoN, the pre-charging TFTs connected between the adjacent data lines are not turned on simultaneously when the video signals Video1, Video2, . . . , VideoN are applied. Accordingly, the pre-charging TFTs CTa1, CTb1, . . . , CTbn do not influence the video signals Video1, Video2, . . . , VideoN applied to the data lines DL11, DL12, . . . , DLNn. In other words, the pre-charging TFTs connected between the adjacent data lines are not turned on simultaneously during an application of the video signals Video1, Video2, . . . , VideoN, so that a short of the adjacent data lines can be prevented.

As described above, since the liquid crystal display device shown in FIG. 9 pre-charges the data lines DL11, DL12, . . . , DLNn using the control signals ϕ1, ϕ2, . . . , ϕn generated from the demultiplexor control signal generator 62, it does not require the separate pre-charge control signal generator. Also, in the liquid crystal display device shown in FIG. 9, since the pre-charging TFTs connected, in series, between the adjacent data lines have a larger resistance value than one pre-charging TFT, a leakage current applied to the data lines DL11, DL12, . . . , DLNn can be minimized. It is desirable that control signals ϕi1, ϕj1, . . . , ϕin, ϕjn for controlling the pre-charging TFTs connected between the adjacent data lines should not be adjacent to each other in such a manner that the adjacent data lines are not short-circuited during an application of the video signals Video1, Video2, . . . , VideoN. Also, it is desirable that loads of the control signals ϕi1, ϕj1, . . . , ϕin, ϕjn should be equally maintained. This aims at identically maintaining a rising time and a falling time of the control signals ϕi1, ϕj1, . . . , ϕin, ϕjn to obtain a uniformity of picture quality.

Figure 10:
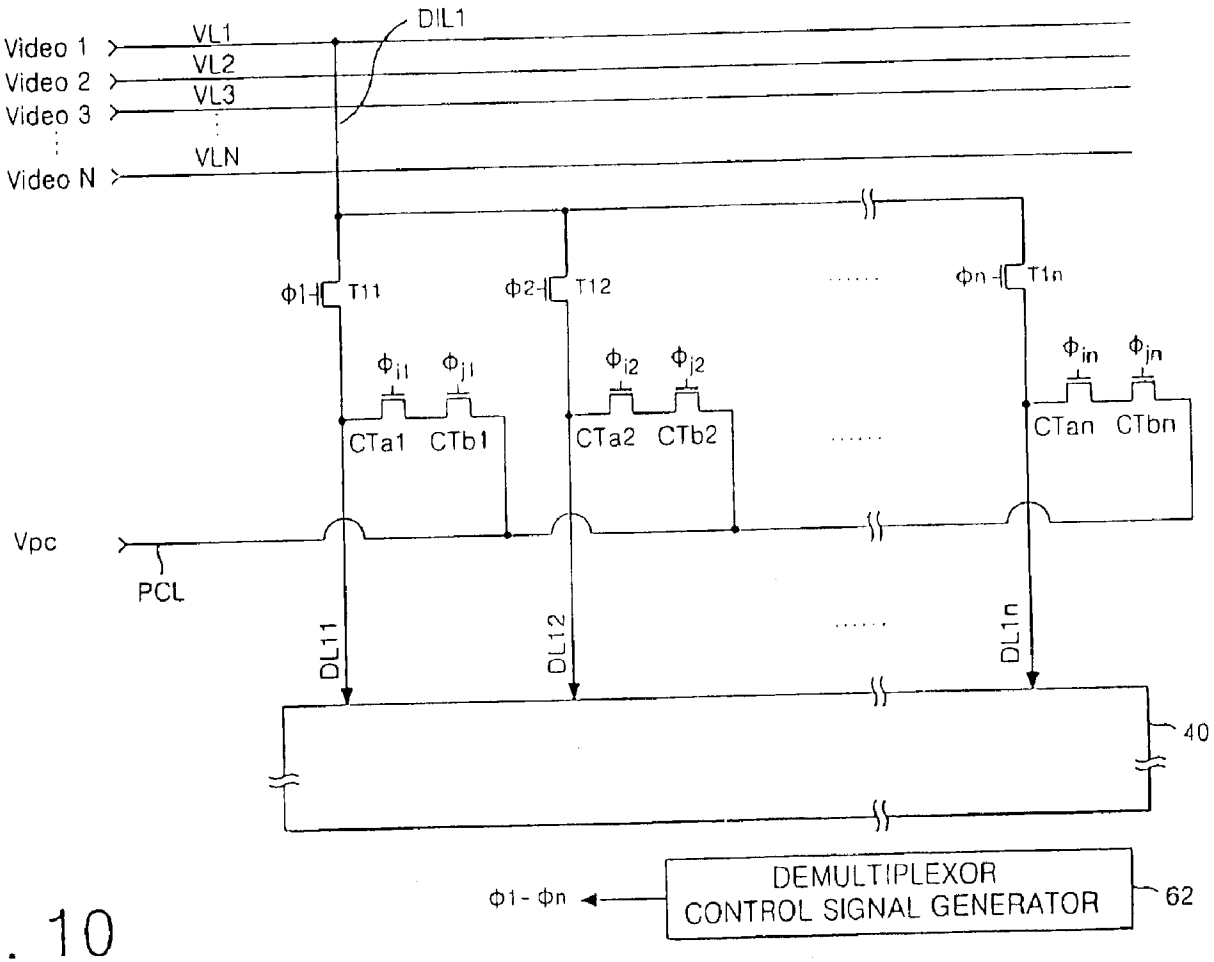
FIG. 10 is a schematic view showing the configuration of a liquid crystal display device according to a third embodiment of the present invention.

Referring to FIG. 10, there is shown a liquid crystal display device according to a third embodiment of the present invention. The liquid crystal display device includes pre-charging TFTs CTa1, CTb1, . . . , CTbn connected, in series, between data lines DL11, DL12, . . . , DLNn and a pre-charging line PCL to commonly apply a pre-charging signal Vpc to the data lines DL11, DL12, . . . , DLNn. The pre-charging TFTs CTa1, CTb1, . . . , CTbn are arranged such that two pre-charging TFTs CTa1 and CTb1 are connected, in series, between one data line and the pre-charge line PCL, for example, between the first data line DL11 and the pre-charge line PCL. A control signal applied to the pre-charging TFTs CTa1, CTb1, . . . , CTbn is identical to a control signal of the demultiplexor TFTs connected to the adjacent data lines. Thus, each of the pre-charging TFTs CTa1, CTb1, . . . , CTbn are controlled simultaneously along with the demultiplexor TFTs connected to the adjacent data lines in response to the control signals ϕ1, ϕ2, . . . , ϕn generated from the demultiplexor control signal generator 62.

Each of the control signals ϕ1, ϕ2, . . . , ϕn is substantially identical to that in FIG. 8. In other words, each of the control signals ϕ1, ϕ2, . . . , ϕn is simultaneously changed to a high logic level in one horizontal synchronizing signal interval 1H. Thus, the horizontal synchronizing signal H is changed to a high logic level and, at the same time, all of the control signals ϕ1, ϕ2, . . . , ϕn are changed to a high level to turn on the pre-charging TFTs CTa1, CTb1, . . . , CTbn simultaneously, thereby short-circuiting all of the data lines DL11, DL12, . . . , DLNn to the pre-charging line PCL. At this time, the pre-charging signal Vpc is applied to the pre-charging line PCL to pre-charge all of the data lines DL11, DL12, . . . , DLNn to the same level. After the data lines DL11, DL12, . . . , DLNn are pre-charged, each of the control signals ϕ1, ϕ2, . . . , ϕn is synchronized with the video signals Video1, Video2, . . . , VideoN to be sequentially changed to a high logic level.

The liquid crystal display device shown in FIG. 10 applies the pre-charging signal Vpc suitable for pre-charging the DL11, DL12, . . . , DLNn, so that it can apply uniform voltages on the DL11, DL12, . . . , DLNn after the pre-charging in comparison to the liquid crystal display device shown in FIG. 9.

Figure 11:
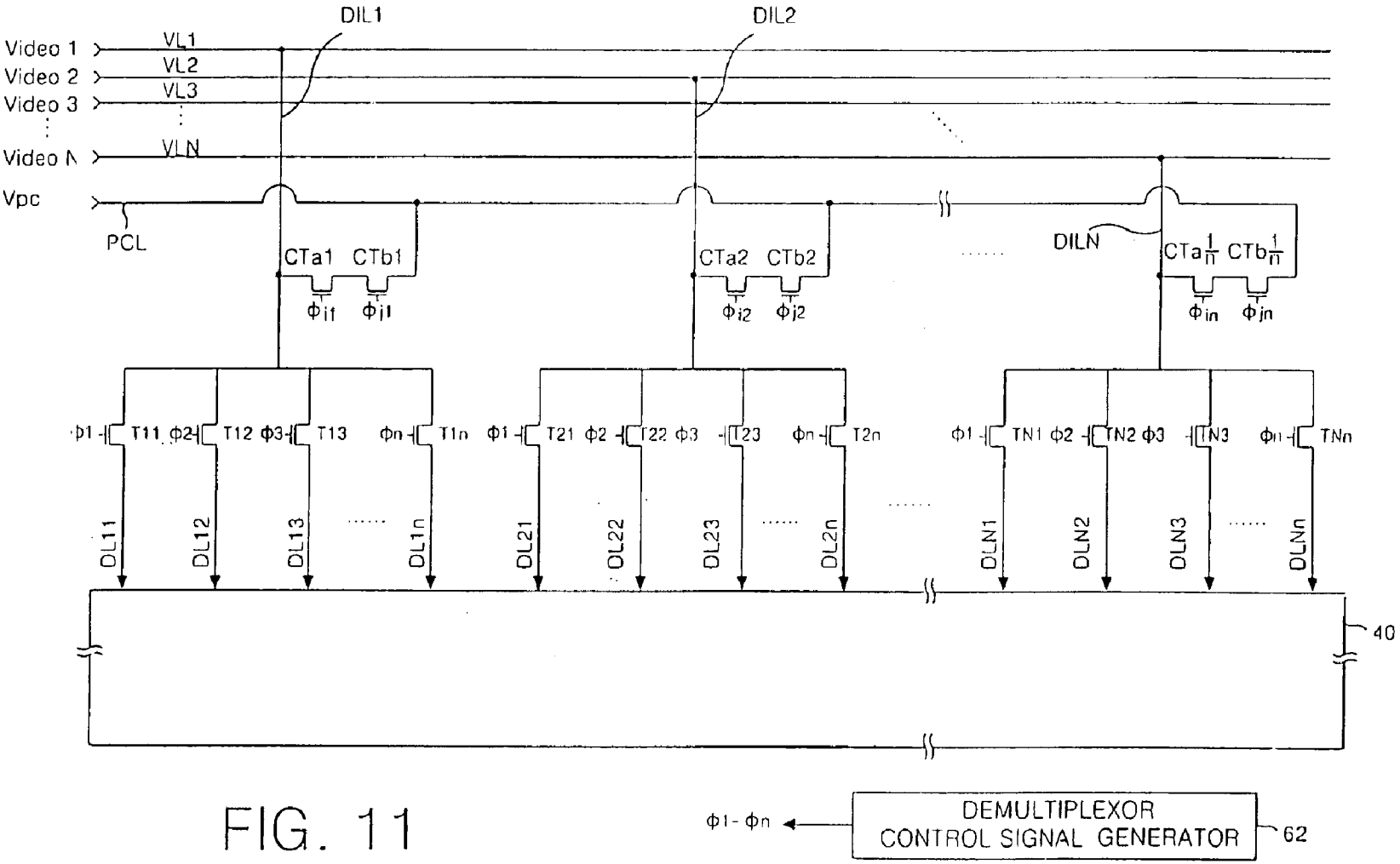
FIG. 11 is a schematic view showing the configuration of a liquid crystal display device according to a fourth embodiment of the present invention.

Referring now to FIG. 11, there is shown a liquid crystal display device according to a fourth embodiment of the present invention. The liquid crystal display device includes pre-charging TFTs CTa1, CTb1, . . . , CTb1/n connected, in series, between demultiplexor input lines DIL1, DIL2, . . . , DILN and a pre-charging line PCL to commonly apply a pre-charging signal Vpc to the data lines DL11, DL12, . . . , DLNn. The pre-charging TFTs CTa1, CTb1, . . . , CTb1/n are arranged such that two pre-charging TFTs CTai and CTbi are connected, in series, between one demultiplexor input line and the pre-charge line PCL, for example, between the first demultiplexor input line DIL1 and the pre-charge line PCL. A control signal applied to the pre-charging TFTs CTa1, CTb1, . . . , CTb1/n is identical to a control signal of the demultiplexor TFTs connected to the adjacent data lines. Thus, each of the pre-charging TFTs CTa1, CTb1, . . . , CTb1/n is controlled simultaneously along with the demultiplexor TFTs connected to the adjacent data lines in response to the control signals ϕ1, ϕ2, . . . , ϕn generated from the demultiplexor control signal generator 62.

Each of the control signals ϕ1, ϕ2, . . . , ϕn is substantially identical to that in FIG. 8. In other words, each of the control signals ϕ1, ϕ2, . . . , ϕn is simultaneously changed to a high logic level in one horizontal synchronizing signal interval 1H. Thus, the horizontal synchronizing signal H is changed to a high logic level and, at the same time, all of the control signals ϕ1, ϕ2, . . . , ϕn are change into a high level to turn on the pre-charging TFTs CTa1, CTb1, . . . , CTb1/n simultaneously, thereby short-circuiting all of the data lines DL11, DL12, . . . , DLNn to the pre-charging line PCL. After the data lines DL11, DL12, . . . , DLNn are pre-charged, each of the control signals ϕ1, ϕ2, . . . , ϕn is synchronized with the video signals Video1, Video2, . . . , VideoN to be sequentially changed into a high logic level.

When the liquid crystal display device shown in FIG. 11 is compared with those in FIG. 9 and FIG. 10, the pre-charging TFTs CTa1, CTb1, . . . , CTbn are connected, in series between the demultiplexor input lines DIL1, DIL2, . . . , DILN and the pre-charging line PCL, so that the number of the pre-charging TFTs is reduced by a factor of at least 1/n. Accordingly, the liquid crystal display device shown in FIG. 11 is capable of reducing an area occupied by the pre-charge circuit in comparison to those in FIG. 9 and FIG. 10. Also, the pre-charge circuit is positioned above the sampling switch part, so that a deterioration of picture quality caused by the pre-charge circuit can be minimized.

As described above, according to the present invention, the data lines are precharged by the sampling switch and the sampling control signal, so that a separate pre-charge circuit such as the pre-charging switch and the pre-charge control signal generator, etc. can be omitted. Furthermore, the data lines are pre-charged using a sampling switch with a large driving ability, so that pre-charge time can be reduced.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving data lines connected to pixels of a liquid crystal display device, said method comprising:

generating a control signal;

mutually short-circuiting the data lines in response to the control signal;

switching paths between a plurality of output electrodes and video signal input lines;

applying pre-charge signal of a desired level to the date lines;

mutually open-circuiting the data lines in response to the control signal; and sequentially applying video signals to the data lines in response to the control signal;

wherein a single control signal is generated for the pre-charge and video signals.

2. A liquid crystal display device, comprising:

a plurality of data lines crossing a plurality of gate lines to form pixels;

a plurality of video signal input lines for supplying video signals to the plurality of data lines;

data driving means for generating a pre-charging signal having a desired pre-charge level;

means for generating a control signal; and switching means for sequentially applying the pre-charging signal to the data lines in response to the control signal to pre-charge the data lines to the desired pre-charge level;

wherein the data driving means comprises:

a plurality of output electrodes connected in series to the video signal input lines;

a plurality of first switches for switching paths between the output electrodes and the video signal input lines;

a pre-charging signal source for generating the pre-charging signal; and a plurality of second switches for switching paths between the pre-charging signal and the video signal input lines.

3. The liquid crystal display device as claimed in claim 2, wherein said switching means is provided between the video signal input lines and the data lines.

4. The liquid crystal display device as claimed in claim 2, wherein said switching means includes a plurality of demultiplexors, each demultiplexor being connected between a corresponding one of the video signal input lines and at least two of the plurality of data lines, wherein each of the demultiplexores responds to the control signal to connect the corresponding video signal input line to the at least two data lines in a time interval when the at least two data lines are pre-charged.

5. The liquid crystal display device as claimed in claim 4, wherein each of the demultiplexors includes a plurality of transistors, each of which has an input electrode connected to a same video signal input line, an output electrode connected to a different data line, and a control electrode connected commonly to the control signal generating means.

6. The liquid crystal display device as claimed in claim 2, wherein said data driving means short-circuits the video signal input lines mutually when the data lines are precharged, and mutually open-circuits the video signal input lines after the data lines are precharged.

7. The liquid crystal display device as claim din claim 6, wherein said data driving means applies the video signals to the data lines after the data lines are pre-charged.

8. The liquid crystal display device as claimed in claim 2, wherein said pre-charging signal source includes a capacitor that discharges a voltage charged thereon to generate the pre-charging signal.

9. A liquid crystal display, comprising:

a plurality of data lines crossing a plurality of gate lines to form pixels;

a plurality of video signal input lines for supplying the video signals to the plurality of data lines;

means for generating a control signal;

a sampling switch device, being responsive to the control signal, to switch between the video input lines and the data lines; and a pre-charge switch device, being responsive to the control signal, to mutually short the data lines, wherein a single control signal is generated for the sampling switch device and the pre-charge switch device.

10. The liquid crystal display device as claimed in claim 9, wherein the pre-charge switches include a plurality of pre-charge switches connected in series between the date lines.

11. The liquid crystal display device as claimed in claim 9, further comprising:

data driving means for applying a signal corresponding to an average voltage of the video signals when the data lines are mutually shorted.

12. A liquid crystal display, comprising:

a plurality of data lines crossing a plurality of gate lines to form pixels;

a plurality of video signal input lines for supplying video signals to the data lines;

a pre-charging signal source for generating a pre-charging signal having a desired level;

means for generating a control signal;

a sampling switch device, being responsive to the control signal, to switch between the video input lines and the data lines;

a pre-charging line for commonly applying the pre-charging signal to the data lines; and a pre-charge switch device, being responsive to the control signal, to connect and disconnect the data lines and the pre-charging line;

wherein a single control signal is generated for the sampling switch device and the pre-charge switch device.

13. The liquid crystal display device as claimed in claim 12, wherein the pre-charge switch device comprises a plurality of pre-charge switches connected in series between the data lines and the pre-charging line.

14. A liquid crystal display comprising:

a pre-charging signal source for generating a pre-charging signal having a desired level;

a plurality of data lines;

a plurality of video signal input lines for supplying video signals to the data lines;

means for generating a control signal;

a demultiplexor, being responsive to the control signal, to apply a single video signal to at least two of the data lines;

a pre-charging line supplied with the pre-charging signal; and a pre-charge switch device, being responsive to the control signal, to switch between an input line of the demultiplexor and the pre-charging line;

wherein a single control signal is generated for the demultiplexor and the pre-charge switch device.

15. The liquid display device as claimed in claim 14, wherein the pre-charged switch device comprises a plurality of pre-charge switches connected in series between the input line of the demultiplexor and the pre-charging line.

* * * * *